US008216026B2

(12) United States Patent
Joslin

(10) Patent No.: US 8,216,026 B2
(45) Date of Patent: Jul. 10, 2012

(54) FORM TRANSFER GRINDING METHOD

(75) Inventor: Frederick Joslin, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 483 days.

(21) Appl. No.: 12/101,478

(22) Filed: Apr. 11, 2008

(65) Prior Publication Data

US 2009/0258579 A1 Oct. 15, 2009

(51) Int. Cl.
*B24B 19/14* (2006.01)

(52) U.S. Cl. ..... 451/59; 451/303; 451/302

(58) Field of Classification Search ..... 451/296, 451/297, 311, 303, 489, 59
See application file for complete search history.

(56) References Cited

U.S. PATENT DOCUMENTS 572,812 A * 12/1896 Longden ..... 451/302
1,025,836 A * 5/1912 Schimmel ..... 451/303
1,082,670 A * 12/1913 Wysong ..... 451/303
2,059,583 A * 11/1936 Jackson et al. ..... 451/529
2,479,506 A * 8/1949 Payton ..... 451/300
2,543,236 A * 2/1951 Dackor et al. ..... 451/167
2,587,603 A 3/1952 Czarnecki
2,701,937 A * 2/1955 Murray ..... 451/168
2,755,604 A * 7/1956 Jameson ..... 451/303
3,170,272 A 2/1965 Burnham
3,984,212 A * 10/1976 DeMusis ..... 451/302
4,051,636 A 10/1977 Heine
4,065,879 A 1/1978 Cretella et al.
4,145,846 A * 3/1979 Howland et al. ..... 451/5
4,309,848 A 1/1982 Arrigoni
4,454,740 A 6/1984 Neal et al.
4,512,115 A 4/1985 Miller
4,662,121 A 5/1987 Ginter
5,139,538 A 8/1992 Morris et al.
5,193,314 A * 3/1993 Wormley et al. ..... 451/5
5,645,466 A 7/1997 Wikle

* cited by examiner

*Primary Examiner* — Robert Rose
(74) *Attorney, Agent, or Firm* — Carlson, Gaskey & Olds, P.C.

(57) ABSTRACT

A method of form transfer grinding a three-dimensional shape utilizes a form transfer tool over which a belt is driven. The form transfer tool includes a shape that is desired in the finished part and guides a belt that grinds an area of a part to a finished or nearly finished condition.

15 Claims, 5 Drawing Sheets

FORM TRANSFER GRINDING METHOD

BACKGROUND OF THE INVENTION

A system and method of forming complex shapes is disclosed. More particularly, a system and method including form transfer grinding system and method for forming airfoil blade retention slots is disclosed.

Complex part configurations utilize many different methods to form the desired features. Many machining methods provide the desired shape, but are unable to provide the desired surface finish, or leave burrs that must be removed. Manually deburring operations conducted by a skilled operator can take an undesirably long time, and care must be taken not to damage the part. Further, the uniformity and consistency between parts utilizing a manual deburring process may not be sufficient for desired purposes. Further, the formation of complex part shapes and geometries can be prohibitively expensive and time consuming and still not provide consistent uniform results.

Accordingly it is desirable to develop a finishing process that reduces process time and that provides repeatable consistent results.

SUMMARY OF THE INVENTION

An example method of form transfer grinding a three-dimensional shape utilizes a form tool over which a belt is driven. The form tool includes a shape that is desired in the finished part and grinds an area of a part to a finished or nearly finished condition.

The example form tool includes a solid form shaped to a desired configuration of a completed part. The shape includes a belt guide surface over which a belt slides. The belt includes an abrasive surface that removes material. The example belt can be rigidly formed to maintain a desired profile that matches the belt guide surface. Alternatively, the example belt can be highly elastic to conform to the shape and contours desired in a completed part. The belt guide surface includes a low friction surface. Pressure or the feed of the form tool into the part, along with belt speed are adjusted to provide the desired material removal, and surface finish of the completed part. Accordingly, the example method and process provides uniform and repeatable finishes and geometries.

These and other features of the present invention can be best understood from the following specification and drawings, the following of which is a brief description.

DETAILED DESCRIPTION OF THE PREFERRED EMBODIMENT

Figure 1:
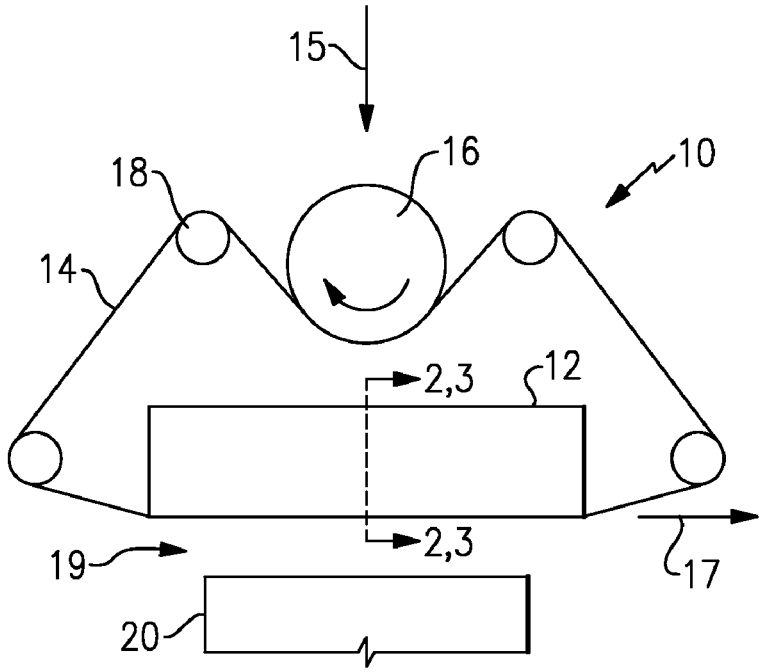
FIG. 1 is a schematic representation of a form transfer grind tool for cutting slots.

Referring to FIG. 1, an example form tool assembly 10 is illustrated for cutting slots or slicing a part 20 into sections. Slots or channels are cut into an example part 20 by a continuous belt 14 driven in direction indicated by arrow 17 by a drive wheel 16 and guided through idlers 18. The example form tool assembly 10 provides a grinding method for cutting or slotting difficult to machine materials and to provide, for example, a starting point or slot for a rotor retention slot.

A form transfer tool 12 includes a substantially rectangular surface on which the belt 14 is driven. The belt 14 is driven by the drive wheel 16 and is aligned to the form tool 12 by idlers 18. The form transfer tool 12 is fed in a direction indicated by the arrow 15 and into the part 20. Coolant is applied as indicated at 19, or alternately the workpiece 20 is immersed in coolant.

Figure 2:
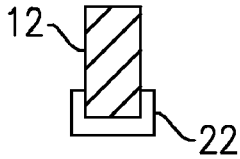
FIG. 2 is a cross-sectional view of an example form transfer grind tool belt retention profile.
Figure 3:
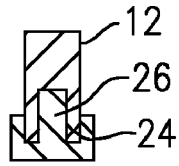
FIG. 3 is another cross-sectional view of an example form transfer tool belt retention profile.

FIG. 2 illustrates a belt profile 22 for maintaining alignment of the belt 14 while forming a slot or cutting slices through the part 20. FIG. 3 is another belt profile 24 that includes a t-shaped extension 26 that aids in maintaining a desired alignment of the belt 24. Other belt profiles for maintaining alignment of the belt 14 on the form tool 12 are also within the contemplation of this invention.

Figure 4:
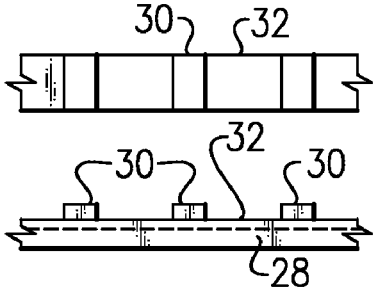
FIG. 4 is a schematic representation of an example abrasive belt.
Figure 5:
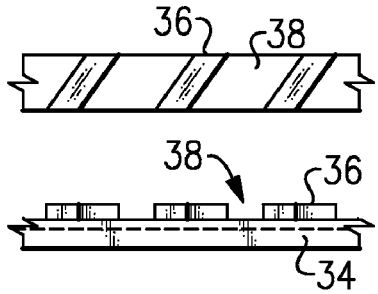
FIG. 5 is a schematic representation of another example abrasive belt.

Referring to FIG. 4 an example belt 28 includes intermediate spaced abrasive portions 30. Abrasive portions 30 are spaced apart and interspersed between spaces 32. The abrasive portions 30 provide for the removal of material from within the portion of the part 20 during cutting operations. Referring to FIG. 5, another belt 34 includes diagonal abrasive portions 36. The diagonal abrasive portions 36 are interspaced between spaces 38. The spaces 38 provide for the removal of material from the part during operation.

Figure 6:
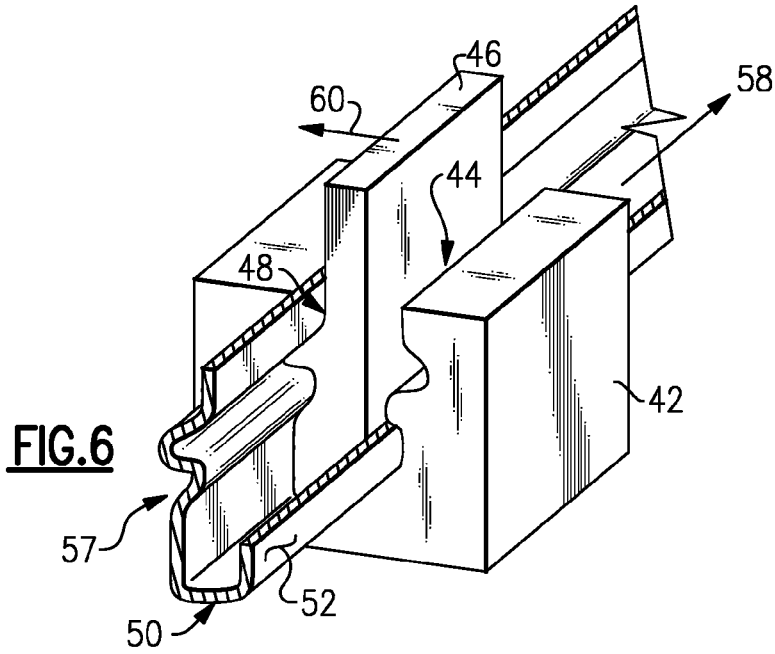
FIG. 6 is a perspective view of a form transfer grind tool and rigid belt for forming an airfoil retention slot.

Referring to FIG. 6, a rotor 42 includes an airfoil retention slot 44 that is formed by a rigid formed belt 50 guided along a shaped form tool 46. The form tool 46 includes a smooth side 48 over which a back side of the rigid belt 50 glides. A force in the direction 60 is exerted on the form tool 46 to engage the belt 50 with the inner surface of the airfoil retention slot 44. The belt 50 is driven in a direction indicated by arrow 58 and grinds away material from within the retention slot 44 to form the desired retention slot features.

The belt 50 is rigid and maintains the desired profile. The example belt 50 is formed from a nickel alloy foil onto which is applied an abrasive grit material for removing material from the rotor 42. The nickel alloy foil is trimmed to a desired width and cut to a length required. The belt 50 is then formed to provide the desired shape that corresponds to the desired end shape of the airfoil retention slot 44. The belt 50 is then joined to provide a continuous belt through an electroplating process. The abrasive grit material applied to the outer surface of the belt 50 is deposited in a uniform manner. Alternatively, the abrasive grit material can be applied in a controlled pattern determined to improve grinding performance.

Figure 7:
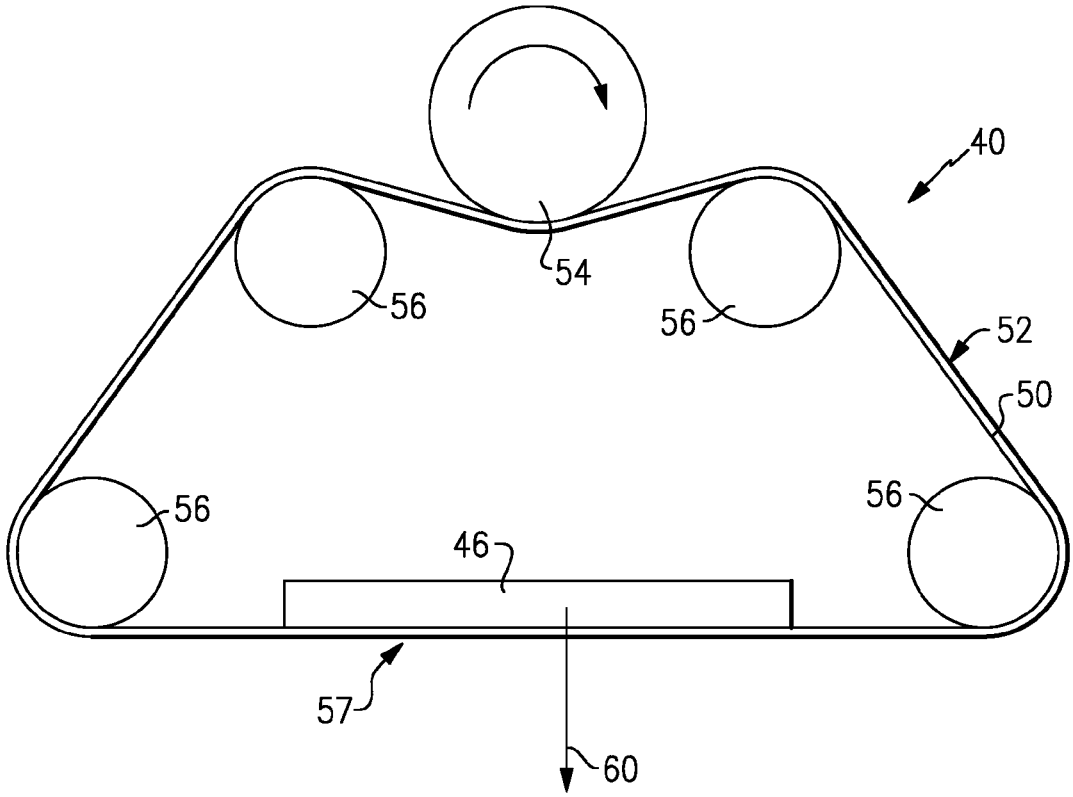
FIG. 7 is schematic view of a system for driving the rigid belt for forming an airfoil retention slot.

Referring to FIG. 7, with continued reference to FIG. 6, a form transfer grinding system 40 is schematically shown and includes the continuous belt 50 with abrasive grit material 52 applied to one side. The belt 50 is substantially rigid to maintain the defined profile (FIG. 6) along the form transfer tool 46. The belt 50 is driven by a drive wheel 54 and guides along through several idlers 56. The drive wheel 54 and each of the idlers 56 include a cross-section that matches the profile of the belt 50. An anti-slip coating is provided on a surface of the drive wheel 54 to provide the required friction to drive the belt 50 through the rotor 42. The belt 50 is driven in a continuous manner by the drive wheel 54. The force 60 applied to the belt 50 by the form tool 46 provides the desired feed determined to most efficiently remove material from the rotor 42. Coolant can be applied as indicated by arrow 57, or alternately the rotor 42 is immersed in coolant.

The example form tool 46 is formed from non-wearing tungsten carbide. The desired profile (FIG. 6) is fabricated utilizing an electrical discharge machining (EDM) operation as is known to those skilled in the art. Other machining processes for machining the material comprising the form tool 46 can be utilized. Further, although the example form tool 46 is fabricated from tungsten carbide, other materials suitable for specific application are also within the contemplation of this invention.

The smooth surface 48 over which the belt 50 rides is polished smooth to a mirrored and highly slippery finish. The mirrored finish reduces friction between the belt 50 and the form transfer tool 46. Additionally, a coating can be applied to the smooth surface 48 to further increase the lubricity of the form tool and further reduce frictional losses.

Figures 8A, 8B, 8C, 8D:
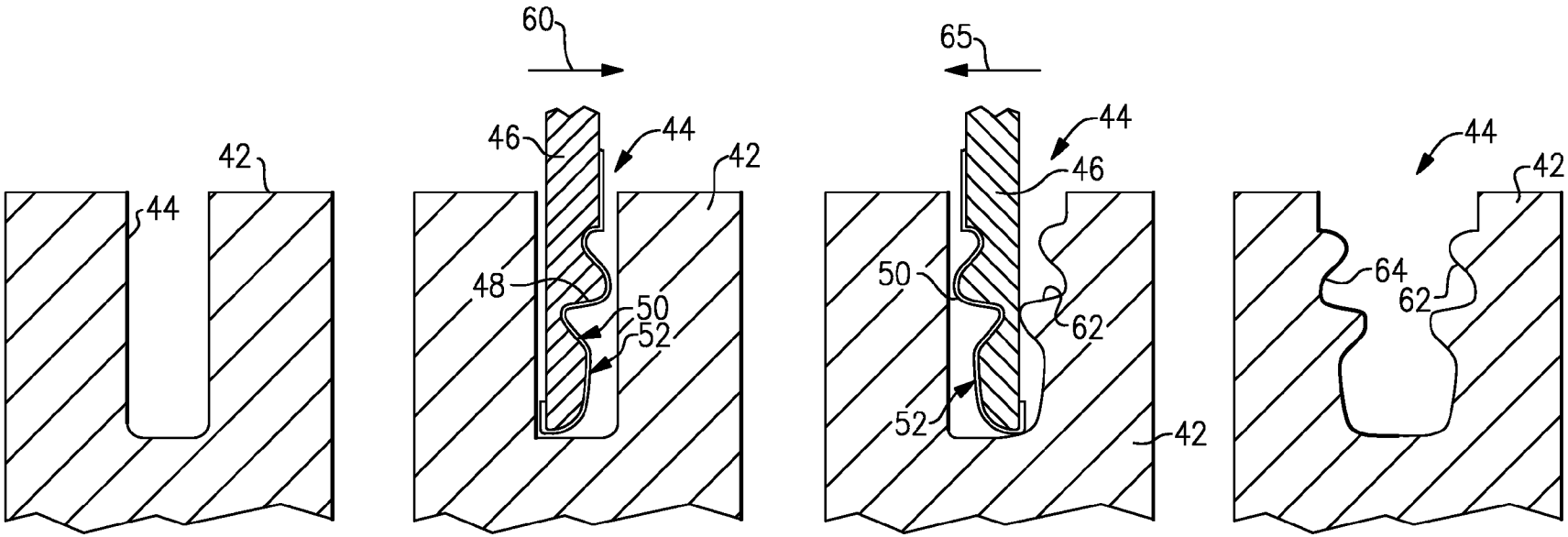
FIG. 8A is a schematic view of an initial rough slot formed in an example rotor.
FIG. 8B is schematic view of form transfer grinding a first side of the airfoil retention slot.
FIG. 8C is a schematic view of form transfer grinding a second side of the airfoil retention slot
FIG. 8D is a schematic representation of a completed form transfer ground airfoil retention slot.

Referring to FIG. 8A-D, the form transfer tool 46 is provided for producing straight and curved airfoil retention slots 44. The airfoil retention slot 44 includes alternating ribs that extend inwardly. The ribs comprise a configuration corresponding to the airfoil for securing the airfoil to the rotor 42 by engaging the alternating ribs of the airfoil retention slot 44. FIG. 8A illustrates the retention slot 44 as a rectangular rough slot prior to formation of the alternating ribs. The rough slot may be produced by conventional grinding methods.

Referring to FIG. 8B, the form transfer tool 46 includes the smooth surface 48 that corresponds to the desired shape of the airfoil retention slot 44. The belt 50 is driven over the smooth surface 48 of the form transfer tool 46. The belt 50 is driven as described and shown with reference to FIGS. 6 and 7 with the drive wheel 54 and a plurality of idlers 56. The form transfer tool 46 is inserted into the slot 44 and is fed in a direction indicated by arrow 60. Coolant as indicated by arrow 57 is applied between the belt 50 and the rotor 42. Alternatively, the rotor 42 is immersed in coolant. The form transfer tool 46 is driven in this direction until the desired depth of one side of the retention slot 44 is complete.

The airfoil retention slot 44 is formed by using a roughing belt that removes a greater amount of material to get close to a finished size. The belt can then be changed to one including a finer abrasive that provides a smoother surface finish. As appreciated, the speed of the belt and feed of the form transfer tool 46 into the side surface of the rotor 42 are adjusted to provide the desired material removal and surface finish.

Referring to FIG. 8C, once the first side of the profile 62 is complete; the form tool 46 is rotated and reinserted into the retention slot 44 to form the second side profile 64. Use of the same form tool 46 on both sides of the airfoil retention slot 44 provides uniform and symmetrical retention features. Further, different form tool profiles could also be utilized to provide the desired profile retention features. Referring to FIG. 8D, the completed airfoil retention slot 44 in the rotor 42 is shown and includes completed first and second side profiles 62, 64.

Figure 9:
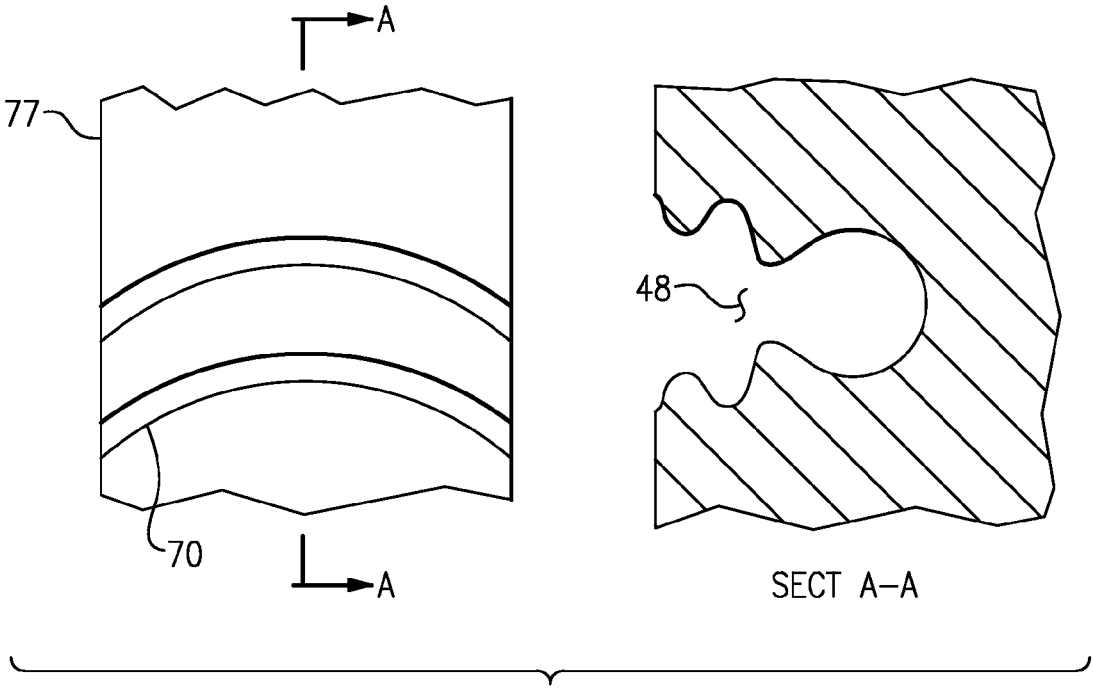
FIG. 9 is a schematic representation of an example curved airfoil retention slot.

Referring to FIG. 9, a curved airfoil retention slot 70 is formed within an example rotor 77 utilizing a cup shaped grinding wheel that generates a rough slot. The rough slot is then form transfer ground to a desired shape and surface finish by curved form transfer grinding tools.

Figure 10:
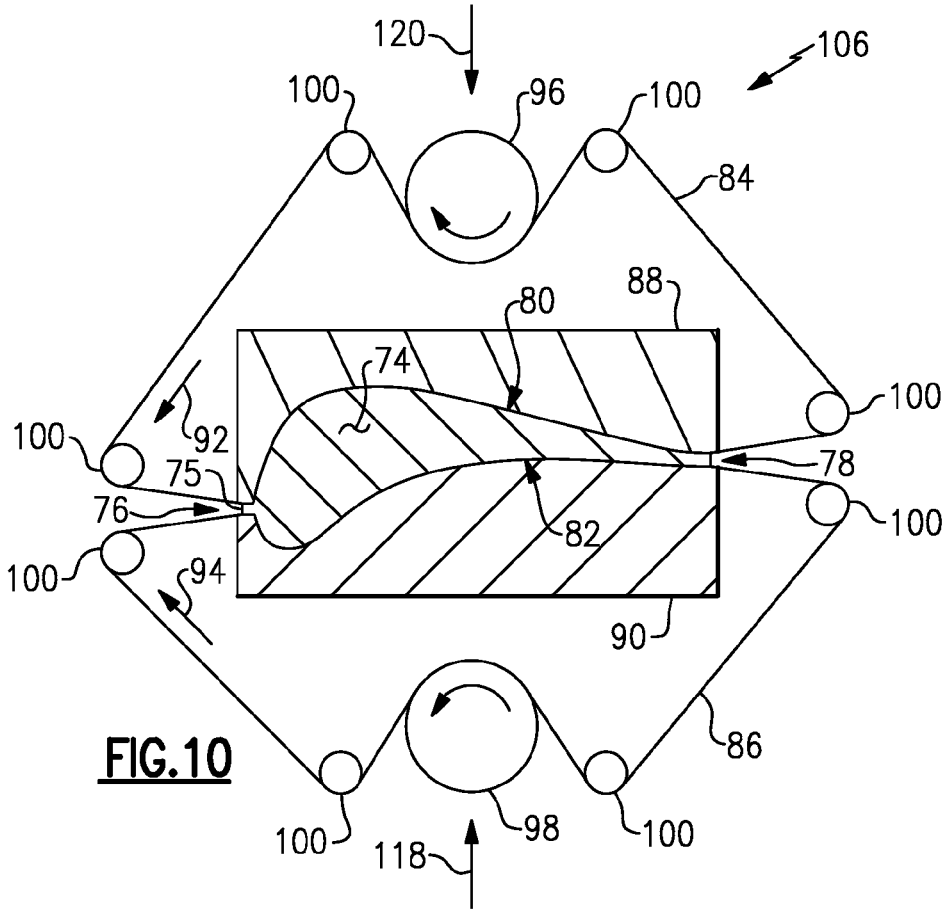
FIG. 10 is a schematic representation of form transfer finish grinding an airfoil.

Referring to FIG. 10, another example area grinding method and form transfer tool assembly is utilized for simultaneously finish grinding both sides of an airfoil 74. The airfoil 74 is disposed and positioned within a finish grind assembly 106. The example airfoil 74 includes a suction side 80 and a pressure side 82. A first form transfer tool 88 and a second form transfer tool 90 include corresponding surfaces that provide the desired finished shape of corresponding sides of the airfoil 74. The form transfer tools 88, 90 are formed of non-wearing hardened steel or tungsten carbide. The form transfer tools 88, 90 include a low friction surface on which belts 84, 86 are guided along the corresponding surfaces of the airfoil 74. The non-wearing side of the form tools includes an area that comprises a three dimensional contour that conforms and provides the desired end shape of the airfoil 74.

The finish grind assembly 106 includes the endless belts 84 and 86. The example belts 84, 86 include an abrasive grit such as cubic boron nitride that is partially encapsulated within a nickel substrate. This nickel substrate including the abrasive grit material is then nickel electroplated to a thin nickel strip. The thin nickel strip provides flexibility such that the belts 84, 86 can conform to the curved and contoured surfaces of the airfoil 74. The length of the belt and the width of the belt are determined based on application specific requirements to finish grind the entire surface of the example airfoil at one time.

The endless belts 84, 86 are driven by corresponding drive wheels 96, 98. The belts 84, 86 are elastic and conform to the surfaces of the form tools 88 and 90. The belts 84, 86 are driven by the drive wheels 96, 98 through a plurality of idlers 100. The idlers 100 are schematically shown along with the drive wheels 96, 98. The configuration and spacing of the drive wheels 96, 98 along with the idlers 100 maintain a desired tension on the belts 84, 86 and aligns the belts 84, 86 as each is driven over the surface of the corresponding form transfer tools 88, 90. Each of the belts 84, 86 travels in a direction indicated by corresponding arrows 92, 94. Coolant is applied at 75 between the belts 84, 86 and the airfoil 74. Alternatively, the airfoil 74 can be immersed in coolant.

The form tools 88, 90 are brought into position against the airfoil 74 in the direction indicated by arrows 118 and 120. A pressure is applied to the form tools 88, 90, that provide the desired material removal rate while maintaining control over the process and optimizing the life of the belts 84, 86. The amount of pressure applied is balanced against material removal rates and durability and operational life of the grinding belts 84, 86.

Figure 11:
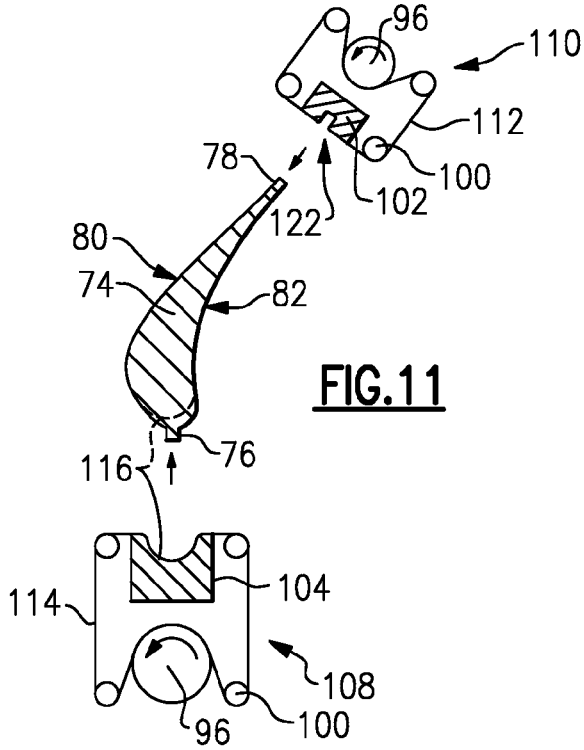
FIG. 11 is a schematic representation of form transfer finish grinding a leading edge and trailing edge of an airfoil.

Referring to FIG. 11 with continued reference to FIG. 10, upon completion of the finished grinding of the suction side 80 and the pressure side 82, a leading edge residue portion 76 and a trailing edge residue portion 78 remain. The residue portions 76, 78 are finish ground to provide the desired shape and configuration to the airfoil 74.

A leading edge form tool assembly 108 and a trailing edge form tool assembly 110 provide for completion of the leading edge and trailing edge surfaces of the airfoil 74. The leading edge form tool assembly 108 includes the drive wheel 96 that drives the belt 114 over the form tool 104. The form tool 104 includes a profile 116 that corresponds to a desired end shape of the leading edge of the airfoil 74. The previous grind and deburring process of the suction and pressure sides results in the formation of the residual portion 76. This residual portion 76 is removed upon engagement with the belt 114 guided along the form tool 104. The surface of the form tool 104 includes a three-dimensional form along the length of the airfoil leading edge. The belt 114 is shown as two dimensional but includes a width equal to the length of the airfoil 74 to provide a consistent and uniform finished surface along the length and width of the leading edge of airfoil 74.

The trailing edge form transfer tool assembly 110 includes the drive wheel 96 that drives belt 112 over a form transfer tool 102. The form transfer tool 102 includes a surface 122 that corresponds to the desired shape of the trailing edge portion of the airfoil 74. The trailing edge form transfer tool 102 accepts the residual portion 78 and grinds that surface until it corresponds to the desired trailing edge surface as is formed and provided by the form 102.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of forming an airfoil retention slot comprising the steps of:

a) forming a slot including an initial width;

b) inserting a form tool assembly into the slot, wherein the form tool assembly includes a desired shape of the finished retention slot;

c) driving an abrasive belt over the form tool; and d) feeding the form tool assembly with the driven abrasive belt into one side of the slot for forming retention features.

2. The method as recited in claim 1, including the step of removing the form tool and reinserting the form tool to contact a second side of the slot and feeding the form tool assembly with the driven abrasive belt into the second side of the slot for forming airfoil retention features on the second side of the slot.

3. The method as recited in claim 2, wherein the airfoil retention features on the first side and the second side are symmetrical.

4. The method as recited in claim 1, wherein the belt is substantially rigid and includes a profile corresponding to the desired shape of the airfoil retention slot.

5. The method as recited in claim 4, wherein the belt comprises a nickel alloy foil that supports an abrasive grit on at least one side of the belt.

6. The method as recited in claim 1, including the step of using a first belt with an abrasive material for removing a first portion of material to form one surface of the airfoil retention slot, and a second belt for providing a desired surface finish of the airfoil retention slot.

7. The method as recited in claim 1, wherein the airfoil retention slot includes an arcuate shape.

8. A method of finish grinding an airfoil, the method comprising the steps of:

driving a first continuous abrasive belt over an area of a first surface of the airfoil, wherein the first continuous abrasive belt is driven along a first form transfer tool having a contour corresponding to a desired final contour of the first surface;

driving a second continuous abrasive belt over an area of a second surface of the airfoil assembly concurrently with driving the first continuous abrasive belt over the first surface, wherein the second continuous abrasive belt is driven along a second form transfer tool having a contour corresponding to a desired final contour of the second surface of the airfoil; and driving a third belt over a third form transfer tool corresponding to a leading edge surface to finish shape the leading edge surface.

9. A method of finish grinding an airfoil, the method comprising the steps of:

driving a first continuous abrasive belt over an area of a first surface of the airfoil, wherein the first continuous abrasive belt is driven along a first form transfer tool having a contour corresponding to a desired final contour of the first surface;

driving a second continuous abrasive belt over an area of a second surface of the airfoil assembly concurrently with driving the first continuous abrasive belt over the first surface, wherein the second continuous abrasive belt is driven along a second form transfer tool having a contour corresponding to a desired final contour of the second; and driving a third belt over a third form transfer tool corresponding to a trailing edge surface to finish shape the trailing edge surface.

10. A form transfer assembly comprising:

a form tool including a finish surface defining a desired profile of a completed feature;

an abrasive belt driven over the finish surface, wherein the abrasive belt is rigid such that the abrasive belt maintains a desired non-planar shape without support, a drive wheel driving the abrasive belt over the finish surface of the form tool, and a plurality of guide pulleys guiding the abrasive belt over the drive wheel and aligning the abrasive belt with the finish surface.

11. The assembly as recited in claim 10, wherein the abrasive belt includes a smooth side gliding against the form tool surface and an abrasive side engaged to form the desired feature.

12. The assembly as recited in claim 11, wherein the abrasive side comprises a plurality of spaced apart abrasive strips separated by open space.

13. The assembly as recited in claim 12, wherein the spaced apart abrasive strips are angled relative to a direction of movement of the abrasive belt.

14. The assembly as recited in claim 10, wherein the abrasive belt includes a contoured shape for forming a contour.

15. The assembly as recited in claim 14, wherein the form tool includes a guide profile that receives a portion of the belt for maintaining alignment.

* * * * *